US008939338B2

(12) United States Patent
Turner et al.

(10) Patent No.: US 8,939,338 B2
(45) **Date of Patent: *Jan. 27, 2015**

(54) AUTOMATICALLY-ADJUSTING WEB MEDIA TENSIONING MECHANISM

(75) Inventors: Nathan J Turner, Rochester, NY (US); Christopher M. Muir, Rochester, NY (US); Thomas Niertit, Webster, NY (US); Randy Eugene Armbruster, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 403 days.

This patent is subject to a terminal disclaimer.

(21) Appl. No.: 13/456,281

(22) Filed: Apr. 26, 2012

(65) Prior Publication Data

US 2013/0287465 A1 Oct. 31, 2013

(51) Int. Cl.

| | |
|---|---|
| ***B65H 23/12*** | (2006.01) |
| ***B65H 23/16*** | (2006.01) |
| ***B65H 23/10*** | (2006.01) |
| ***B65H 23/188*** | (2006.01) |

(52) U.S. Cl.

CPC ..... *B65H 23/16* (2013.01); *B65H 23/12* (2013.01); *B65H 23/105* (2013.01); *B65H 23/188* (2013.01); *B65H 2404/1521* (2013.01); *B65H 2801/15* (2013.01); *B65H 2301/31122* (2013.01); *Y10S 101/42* (2013.01)

USPC .. 226/195; 242/419.7; 101/228; 101/DIG. 42

(58) Field of Classification Search

CPC ..... B65H 23/10; B65H 23/105; B65H 23/12; B65H 23/14; B65H 23/16; B65H 23/188; B65H 2404/1521; B65H 2801/15; B65H 2301/31122

USPC ..... 226/44, 118.2, 118.3, 180, 195; 242/417, 417.2, 417.3, 419, 419.1, 242/419.6, 419.7, 615.3; 101/219, 228, 101/DIG. 42

See application file for complete search history.

(56) References Cited

U.S. PATENT DOCUMENTS

| | | | | | |
|---|---|---|---|---|---|
| 944,161 | A * | 12/1909 | Wight | 242/417.3 |
| 2,436,067 | A * | 2/1948 | Fonda | 139/104 |
| 4,410,122 | A * | 10/1983 | Frye et al. | 242/615.2 |
| 4,805,111 | A * | 2/1989 | Steidel | 700/122 |
| 5,031,847 | A * | 7/1991 | Tanaka | 242/417.3 |
| 5,360,152 | A | 11/1994 | Matoushek | |
| 2005/0153100 | A1 * | 7/2005 | Zoller et al. | 428/131 |
| 2009/0101686 | A1 | 4/2009 | Lane | |
| 2011/0077115 | A1 | 3/2011 | Dunn | |
| 2011/0128337 | A1 | 6/2011 | Muir et al. | |
| 2011/0129278 | A1 | 6/2011 | Muir et al. | |

* cited by examiner

*Primary Examiner* — William E Dondero

(74) *Attorney, Agent, or Firm* — Kevin E Spaulding

(57) ABSTRACT

An automatically-adjusting tensioning mechanism for use in a roll-fed web media transport system, the tensioning mechanism adding tension to the web media, comprising a bracket assembly being adapted to freely pivot around a pivot axis, and first and second tensioning shoe having curved surfaces attached to the bracket assembly. The web media feeds through the tensioning mechanism in an S-shaped media path where the web media is wrapped around the first and second tensioning shoes. The pivot angle of the bracket assembly automatically adjusts in response to differences in a coefficient of friction between the web media and the tensioning shoes such that the tension in the web media has a reduced level of variability relative to configurations where the bracket assembly is held in a fixed position.

20 Claims, 13 Drawing Sheets

| Web Media | Fixed S-Wrap Tensioning Mechanism (0° Pivot Angle) | Automatically-Adjusting S-Wrap Tensioning Mechanism |
|---|---|---|
| | Tension (lb) | Tension (lb) |
| #1 | 40 | 18 |
| #2 | 198 | 33 |
| #3 | 64 | 20 |
| #3 (Coated) | 20 | 26 |
| #4 | 10 | 16 |

*FIG. 11*

AUTOMATICALLY-ADJUSTING WEB MEDIA TENSIONING MECHANISM

CROSS-REFERENCE TO RELATED APPLICATIONS

Reference is made to commonly assigned, co-pending U.S. Patent Application Serial No. 13/456,296 , entitled: "Method for automatically-adjusting web media tension", by Turner et al., which is incorporated herein by reference.

FIELD OF THE INVENTION

This invention generally relates to a digital printing system for web media, and more particularly to a web media tensioning mechanism that adjusts responsive to changes in characteristics of the web media.

BACKGROUND OF THE INVENTION

Continuous web printing allows economical, high-speed, high-volume print reproduction. In this type of printing, a continuous web of paper or other print media material is fed past one or more printing subsystems that form images by applying one or more colorants onto the print media surface. With this type of printing system, finely controlled dots of ink are rapidly and accurately propelled from the printhead onto the surface of a moving print media, with the web of print media often coursing past the printhead at speeds measured in hundreds of feet per minute. During printing, variable amounts of ink may be applied to different portions of the rapidly moving print media web, with drying mechanisms typically employed after each printhead or bank of printheads. Variability in ink or other liquid amounts and types or variability in drying times can cause print media stiffness and tension characteristics to vary dynamically for different types of print media, contributing to the overall complexity of print media handling and print media dot registration.

In some prior art web printing systems, such as the KODAK VERSAMARK VT3000 Printing System, the web media is slack when it enters the printing system and an "S-wrap" tensioning mechanism is used to add tension to the web media in preparation for feeding the web media into the rest of the system. S-wrap tensioning mechanisms provide an S-shaped media path where the web media is pulled across curved surfaces of tensioning shoes. Friction between the web media and the tensioning shoes introduce a tension into the web media.

The amount of tension introduced into the web media by an S-wrap tensioning mechanism will be a function of the coefficient of friction between the web media and the tensioning shoes. As a result, the amount of tension provided in a particular configuration can vary widely depending on the factors such as characteristics of the web media, operating speed and environmental conditions. Therefore, it is commonly necessary to manually adjust the geometry of the S-wrap tensioning mechanism (for example, by adjusting a wrap angle) to tune the system performance in accordance with the variation in these factors. Such manual adjustments can be time-consuming, and can be prone to operator error.

U.S. Patent Application Publication 2009/0101686 to Lane, entitled "Web processing apparatus," discloses a web tensioning assembly configured to balance the tension across the width of a web. With this arrangement, the tension in the web media before and after the tensioning assembly will be the same. Therefore it is incompatible with applications where tension needs to be added to a slack web media.

U.S. Patent Application Publication 2011/0077115 to Dunn, entitled "System and method for belt tensioning," discloses a method for adding tension to a belt which involves using a spring to apply a force to a tensioning roller. This configuration provides a controlled amount of tension throughout a closed belt, but cannot be used to add tension to a slack web media.

There remains a need for a tensioning mechanism for adding tension to a slack web that provides a consistent level of tension independent of varying media and environmental characteristics.

SUMMARY OF THE INVENTION

The present invention represents an automatically-adjusting tensioning mechanism for use in a roll-fed web media transport system, the tensioning mechanism adding tension to the web media, the web media having a width, comprising:

a bracket assembly mounted to a frame, the bracket assembly being adapted to freely pivot around a pivot axis through a range of pivot angles, the pivot axis being oriented in a direction across the width of the web media;

a first tensioning shoe extending in a lengthwise direction across the width of the web media and having a first curved surface, the first tensioning shoe being attached to the bracket assembly; and a second tensioning shoe extending in a lengthwise direction across the width of the web media and having a second curved surface, the second tensioning shoe being attached to the bracket assembly at a fixed distance from the first tensioning shoe;

wherein the web media feeds through the automatically-adjusting tensioning mechanism in an S-shaped media path where the web media is wrapped around the first curved surface of the first tensioning shoe and is wrapped around the second curved surface of the second tensioning shoe such that a frictional drag resulting from friction between the web media and the first and second tensioning shoes provides a tension in the web media as it exits the automatically-adjusting tensioning mechanism, the web media being in contact with the first curved surface for a first contact distance and being in contact with the second curved surface for a second contact distance;

and wherein the pivot angle of the bracket assembly automatically adjusts in response to differences in a coefficient of friction between the web media and the first and second tensioning shoes such that the tension in the web media as it exits the automatically-adjusting tensioning mechanism has a reduced level of variability as a function of the coefficient of friction relative to configurations where the bracket assembly is held in a fixed position.

This invention has the advantage that it provides adequate pre-tensioning of the web media independent of the frictional characteristics of the web media without the need for manual reconfiguration.

It has the additional advantage that the tensioning mechanism automatically and passively adjusts to correct for variations in the friction coefficient in real time during a printing process.

It has the further advantage that the tensioning mechanism is more robust and less prone to human errors that may be introduced with prior art tensioning mechanisms that require manual reconfiguration.

BRIEF DESCRIPTION OF THE DRAWINGS

In the detailed description of the example embodiments of the invention presented below, reference is made to the accompanying drawings, in which:

FIG. 11 is a table comparing the variability in the web media tension provided with an automatically-adjusting tensioning mechanism in accordance with the present invention to that of a conventional fixed S-wrap tensioning mechanism;

Figure 1:
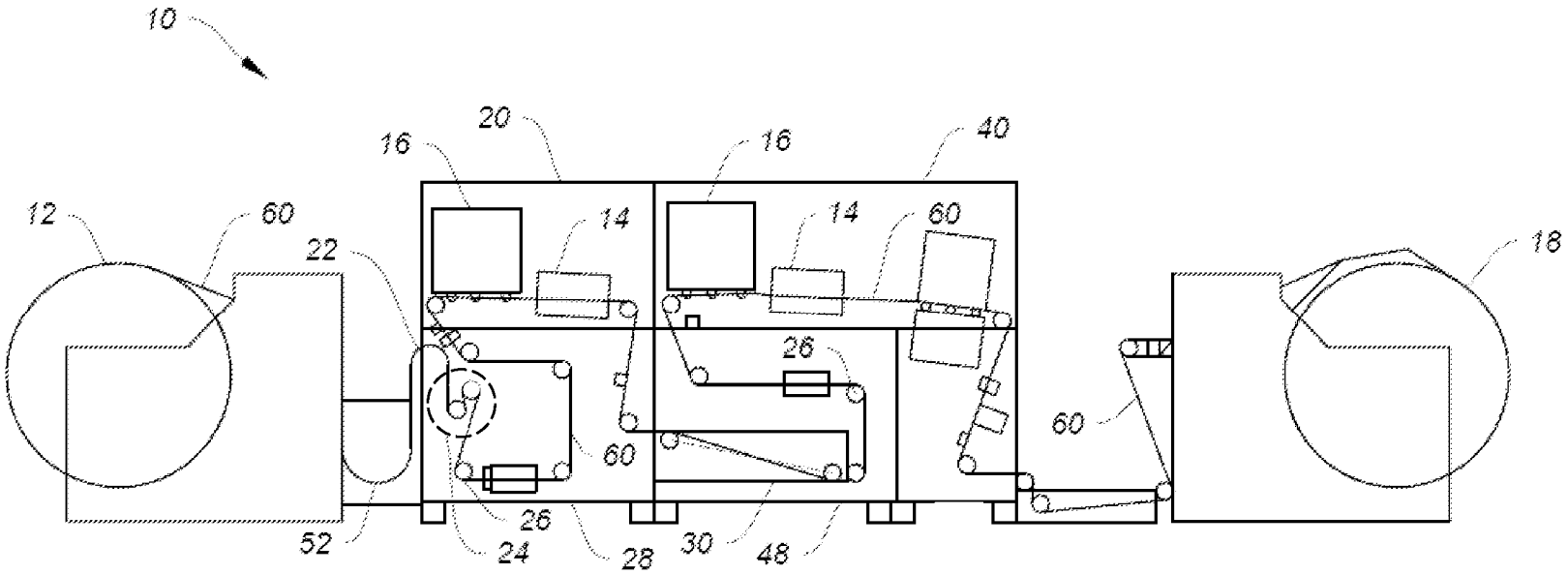
FIG. 1 is a schematic side view of a digital printing system according to an example embodiment of the present invention.

It is to be understood that the attached drawings are for purposes of illustrating the concepts of the invention and may not be to scale.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

The apparatus and method of the present invention are well suited for roll-fed web media transport systems. In a preferred embodiment, the roll-fed web media transport system is part of a roll-fed printing system that applies colorant (e.g., ink) to a web of continuously moving print media. In some embodiments, the printing system is a non-contact printing system that provide for the application of ink or other colorant onto web media. In such systems a printhead selectively moistens at least some portion of the media as it moves through the printing system, but without the need to make contact with the print media. While the present invention will be described within the context of a roll-fed printing system, it will be obvious to one skilled in the art that it could also be used for other types of systems that include a roll-fed web media transport system. For example, the present invention can be used in a roll-fed coating system that coats one or more layers of material onto a web of continuously moving substrate.

In the context of the present invention, the terms "web media" or "continuous web of media" are interchangeable and relate to a media (e.g., a print media) that is in the form of a continuous strip of media as it passes through the web media transport system from an entrance to an exit thereof. The continuous web media serves as the receiving medium to which one or more colorants (e.g., inks or tonors), or other coating liquids are applied. This is distinguished from various types of "continuous webs" or "belts" that are actually transport system components (as compared to the print receiving media) which are typically used to transport a cut sheet medium in an electrophotographic or other printing system. The terms "upstream" and "downstream" are terms of art referring to relative positions along the transport path of a moving web; points on the web move from upstream to downstream.

Additionally, as described herein, the example embodiments of the present invention provide a printing system or printing system components typically used in inkjet printing systems. However, many other applications are emerging which use inkjet printheads to emit liquids (other than inks) that need to be finely metered and deposited with high spatial precision. As such, as described herein, the terms "liquid," "ink," "print," and "printing" refer to any material that can be ejected by the liquid ejector, the liquid ejection system, or the liquid ejection system components described below.

Kinematic web handling is provided not only within each module of the system described below, but also at the interconnections between modules, as the continuously moving web medium passes from one module to another. Unlike a number of conventional continuous web imaging systems, the apparatus described below does not require a slack loop between modules, but typically uses a slack loop only for media that has been just removed from the supply roll at the input end. Removing the need for a slack loop between modules or within a module allows the addition of a module at any position along the continuously moving web, taking advantage of the automatically-adjusting and self-correcting design of media path components. As part of this adaptation, techniques have been developed to enable the moving web media to maintain proper tension in a "passive" manner.

Referring to the schematic side view of FIG. 1, there is shown a digital printing system 10 for continuous web printing according to one example embodiment of the invention. A first module 20 and a second module 40 are provided for guiding continuous web media 60 that originates from a source roller 12. Following an initial slack loop 52, the web media 60 that is fed from source roller 12 is then directed through digital printing system 10, past one or more printheads 16 and supporting components of the digital printing system 10. Module 20 has a support structure 28 that includes a cross-track positioning mechanism 22 for positioning the continuously moving web media 60 in the cross-track direction, that is, orthogonal to the direction of travel and in the plane of travel. In one embodiment, the cross-track positioning mechanism 22 is an edge guide for registering an edge of the moving web media 60. A tensioning mechanism 24, affixed to the support structure 28 of module 20, includes structure that pretensions the web media 60. In accordance with the present invention, the tensioning mechanism 24 is automatically adjusting to provide a substantially constant amount of tension of the web media 60 independent of the characteristics of the web media 60. Additional details of the tensioning mechanism 24 will be described later with reference to FIG. 4 and following.

The second module 40, positioned downstream from the first module 20 along the path of the web media 60, also has a support structure 48, similar to the support structure 28 for module 20. Affixed to one or both of the support structures 28 and 48 is a kinematic connection mechanism that maintains the kinematic dynamics of the continuous web of web media 60 in traveling from the module 20 into the module 40. Also affixed to one or both of the support structures 28 and 48 are one or more angular constraint structures 26 for setting an angular trajectory of the web media 60.

Printing system 10 optionally includes a turnover mechanism 30 that is configured to turn the media 60 over, flipping it backside-up in order to allow printing on the reverse side as the web media 60 as it travels through module 40. When printing is complete, the web media 60 leaves the digital printing system 10 and travels to a media receiving unit, in this case a take-up roller 18. A roll of printed media is then formed, rewound from the printed web media 60. The printing system 10 can include a number of other components, including, for example, dryers 14 and additional print heads (e.g., for different colored inks), as will be described in more detail below. Other examples of digital printing system components include web cleaners, web tension sensors, or quality control sensors.

Figure 2:
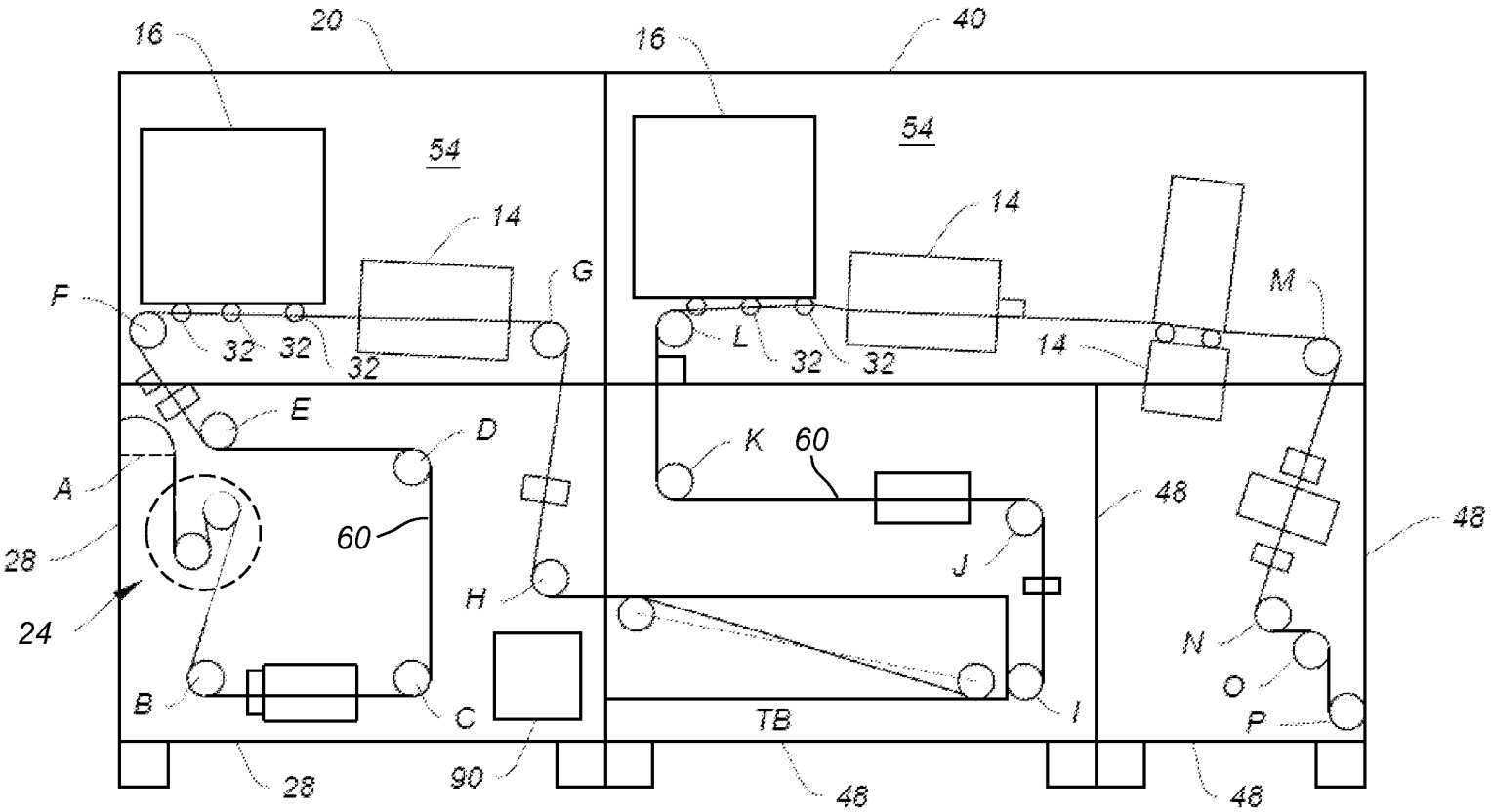
FIG. 2 is an enlarged schematic side view of media transport components of the digital printing system shown in FIG. 1.

Referring to the schematic side view of FIG. 2, an enlarged view of a portion of the printing system 10 of FIG. 1 is shown and includes the web media 60 routing path through the modules 20 and 40. Within both modules 20 and 40, in a print zone 54, a printhead 16 is followed by a dryer 14. Optionally, the digital printing system 10 can also include other components within either or both of the modules 20 and 40. Examples of these types of system components include components for inspection of the print media, for example, components to monitor and control print quality.

Table 1 identifies the lettered components used for web media transport and shown in FIG. 2. An edge guide A is provided in which the web media 60 is pushed laterally so that an edge of the web media 60 contacts a stop. The slack web entering the edge guide A allows the web media 60 to be shifted laterally without interference and without being over constrained. An S-wrap tensioning mechanism 24 provides curved surfaces over which the web media 60 slides during transport. As the web media 60, for example, an inkjet paper, is pulled over the curved surfaces of the tensioning mechanism 24, the friction of the web media 60 across these surfaces produces tension in the web media 60 feeding into roller B. As will be discussed below, in accordance with the present invention, the tensioning mechanism 24 is automatically adjusting to provide a substantially constant amount of tension of the web media 60 independent of the characteristics of the web media 60.

TABLE 1

Web media transport components listing for FIG. 2

| Media Handling Component | Type of Component |
|---|---|
| A | Edge guide (lateral constraint) |
| 24 | Tensioning Mechanism (zero constraint) |
| B | In-feed drive roller (angular constraint) |
| C | Castered and gimbaled roller (zero constraint) |
| D * | Gimbaled roller (angular constraint with hinge) |
| E | Edge guide (lateral constraint) OR Servo-caster with gimbaled roller (steered angular constraint with hinge) |
| F | Fixed roller (angular constraint) |
| G | Servo-caster with gimbaled roller (steered angular constraint with hinge) |
| H | Gimbaled roller (angular constraint with hinge) |
| TB | Turnover module |
| I | Castered and gimbaled roller (zero constraint) |
| J * | Gimbaled roller (angular constraint with hinge) |
| K | Edge guide (lateral constraint) OR Servo-caster with gimbaled roller (steered angular constraint with hinge) |
| L | Fixed roller (angular constraint) |
| M | Servo-caster with gimbaled roller (steered angular constraint with hinge) |
| N | Out-feed drive roller (angular constraint) |
| O | Castered and gimbaled roller (zero constraint) |
| P | Gimbaled roller (angular constraint with hinge) |

Note:
Asterisk (*) indicates locations of load cells

The first angular constraint is provided by in-feed drive roller B. This is a fixed roller that cooperates with a drive roller in the turnover section TB and with out-feed drive roller N in module 40 in order to move the web media 60 through the printing system with suitable tension in the direction of movement or travel in the web media 60 (generally from left to right as shown in FIG. 2). The tension provided by the preceding tensioning mechanism 24 serves to hold the paper against the in-feed drive roller B so that a nip roller is not required at the drive roller. Angular constraints at subsequent locations downstream along the web are often provided by rollers that are gimbaled so as not to impose an angular constraint on the next downstream web span.

The media transport system of the example embodiment shown in FIG. 2 includes other components. The edge guide A at the beginning of the web media path provides lateral constraint for registering the continuous web media 60. However, given this lateral constraint and the following angular constraint, the lateral constraint for subsequent web spans can be fixed. In one example embodiment, a gentle additional force is applied along the cross-track direction as an aid for urging the web media 60 edge against the edge guide A. This force is often referred to as a nesting force as the force helps cause the edge of the web media 60 to nest alongside the edge guide A. A suitable edge guide is described in commonly-assigned U.S. Patent Application Publication 2011/0129278, published on Jun. 2, 2011, entitled "Edge guide for media transport system", by Muir et al., the disclosure of which is incorporated by reference herein in its entirety.

In one example embodiment of the present invention, cross track position of the print media is center justified as it enters the media operating zone. This is done at transport element E either by a passive centering web guide (for example, by a web guide such as is described in commonly-assigned U.S. Pat. No. 5,360,152 entitled "Web guidance mechanism for automatically centering a web during movement of the web along a curved path" by Matoushek, the disclosure of which is incorporated by reference herein in its entirety) or by an active centering web guide (for example, by a servo-caster with gimbaled roller (i.e., a steered angular constraint with hinge), as is described in commonly-assigned U.S. patent application Ser. No. 13/292,117, the disclosure of which is incorporated by reference herein in its entirety). Fixed rollers F and L precede printhead(s) 16 in the first module 20 and the second module 40, respectively, providing the desired angular constraint to the web in each print zone 54. These rollers provide a suitable location for mounting an encoder for monitoring the motion of the web media 60 through the printing system 10. Under printheads 16, the web media 60 is supported by fixed non-rotating supports 32, for example, brush bars. Alternatively, fixed rollers can support the paper under the printheads, if the print media has minimal wrap around the rollers. Supports 32 provide minimal constraint to the web.

Printhead 16 prints in response to supplied print data on the web media 60 in the span between roller F and G, which includes the media operation zone. Water-based inks add moisture to the print media, which can cause the print media to expand, especially in the cross-track direction. The added moisture also lowers the stiffness of the print media. Dryer 14 following the printhead 16 dries the ink, typically by a directing heat and a flow of air at the print media. The dryer drives moisture out of the print media, causing the print media to shrink and its stiffness to change. These changes to the print media in the media operation zone can cause the print media to drift in the cross-track direction as it passes through the media operation zone. The width of the print media as it leaves the media operation zone can also differ from the width of the print media as it entered the media operation zone. To accommodate these effects, one example embodiment of the present invention includes a servo-caster with gimbaled roller G (i.e., a steered angular constraint with hinge) to center justify the print media as it leaves the media operation zone. Because of the relative length to width ratio of the web media 60 in the segment between rollers F and G, the continuous web media 60 in that segment is considered to be non-stiff, showing some degree of compliance in the cross-track direction. As a result, the additional constraint provided by the steered angular constraint can be included without over constraining that web segment.

A similar configuration is used in the second module 40. Accordingly, in one example embodiment of the present invention servo-caster with gimbaled roller M (a steered angular constraint with hinge) is included to center justify the web media 60 as it leaves the media operation zone. Roller K includes either a passive web centering guide (for example, the centering guide of U.S. Pat. No. 5,360,152) or an active mechanism such as a servo-caster with gimbaled roller (a steered angular constraint with hinge) to center justify the print media as it enters the media operation zone.

The angular orientation of the web media 60 in the print zone containing one or more printheads and possibly one or more dryers is controlled by a roller placed immediately before or immediately after the print zone. This is critical for ensuring registration of the images printed from multiple printheads 16. It is also critical that the web not be over constrained in the print zones 54. As a result of the transit time of the ink drops from the printhead 16 to the web media 60 that can result from variations in spacing of the printhead to the web media 60 from one side of the printhead to the other, it is desirable to orient the printheads 16 parallel to the web media 60. To maintain the uniformity of the spacing between the printheads 16 and the web media 60, constraint relieving rollers placed at one end of the print zones 54 are preferably not free to pivot in a manner that will alter the spacing between printheads 16 and the web media 60. Therefore, the castered roller following the print zone should preferably not include a gimbal pivot. However, the use of non-rotating supports 32 under the media 60 in the print zone as shown in FIG. 2 can be used to eliminate this design restriction.

Figure 3:
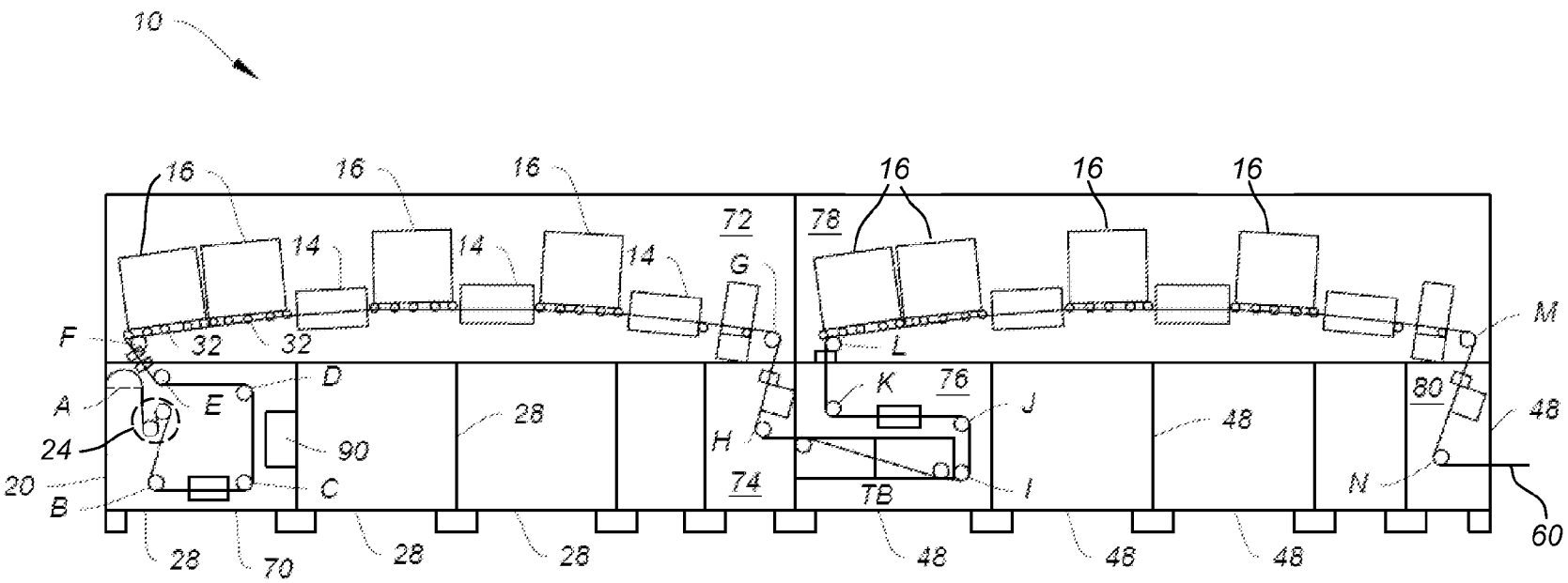
FIG. 3 is a schematic side view of a large-scale two-sided digital printing system according to another example embodiment of the present invention.

Another example embodiment of a printing system 10 shown schematically in FIG. 3 has a considerably longer print path than that shown in FIG. 2 where a plurality of printheads 16 are provided in each of a first printhead module 72 and a second printhead module 78. The plurality of printheads 16 can be used to print different ink colors (e.g., cyan, magenta, yellow and black) to enable the printing of color images. The print path shown in FIG. 3 provides the same overall sequence of angular constraints as the FIG. 2 configuration, with the same overall series of gimbaled, castered, and fixed rollers. Table 2 lists the arrangement of media transport components used with the system of FIG. 3 for one example embodiment of the invention. Non-rotating supports 32, for example, brush bars, shown between rollers rollers F and G and between rollers L and M in FIG. 3, include non-rotating surfaces and thus apply no lateral or angular constraint forces. In accordance with the present invention, tensioning mechanism 24 automatically adjusts to reduce variability in the tension of the web media 60 as well be described below.

TABLE 2

Web media transport components listing for FIG. 3

| Media Handling Component | Type of Component |
|---|---|
| A | Edge guide (lateral constraint) |
| 24 | Tensioning Mechanism (zero constraint) |
| B | In-feed drive roller (angular constraint) |
| C | Castered and gimbaled roller (zero constraint) |
| D * | Gimbaled roller (angular constraint with hinge) |
| E | Edge guide (lateral constraint) OR Servo-caster with gimbaled roller (steered angular constraint with hinge) |
| F | Fixed roller (angular constraint) |
| G | Servo-caster with gimbaled roller (steered angular constraint with hinge) |
| H | Gimbaled roller (angular constraint with hinge) |
| TB | Turnover module |
| I | Castered and gimbaled roller (zero constraint) |
| J * | Gimbaled roller (angular constraint with hinge) |
| K | Edge guide (lateral constraint) OR Servo-caster with gimbaled roller (steered angular constraint with hinge) |
| L | Fixed roller (angular constraint) |
| M | Servo-caster with gimbaled roller (steered angular constraint with hinge) |
| N | Out-feed drive roller (angular constraint) |

Note:
Asterisk (*) indicates locations of load cells

For the embodiments shown in FIG. 2 and FIG. 3, the pacing drive component of the printing system 10 is the turnover module TB. Turnover module TB is conventional and has been described in commonly-assigned U.S. Patent Application Publication 2011/0128337, entitled "Media transport system for non-contact printing", by Muir et al., the disclosure of which is incorporated by reference herein in its entirety.

Load cells are provided in order to sense web tension at one or more points in the system. In the embodiments shown in FIG. 2 (Table 1) and FIG. 3 (Table 2), load cells are provided at gimbaled rollers D and J. Control logic for the respective printing system 10 monitors load cell signals at each location and, in response, makes any needed adjustment in motor torque in order to maintain the proper level of tension throughout the system. There are two tension-setting mechanisms, one preceding and one following turnover module TB, which cooperate with the tensioning mechanism 24 to control the tension in the web media 60 as it moves through the printing system 10. On the input side, load cell signals at roller D indicate tension of the web preceding turnover module TB; similarly, load cell signals at roller J indicate web tension on the output side, between turnover module TB and take-up roll 18 (not shown in FIG. 3). Control logic for the appropriate in- and out-feed driver rollers at B and N, respectively, can be provided by an external computer or processor, not shown in figures of this application. Optionally, an on-board control logic processor 90, such as a dedicated microprocessor or other logic circuit, is provided for maintaining control of web tension within each tension-setting mechanism and for controlling other machine operation and operator interface functions. As described, the tension in a module preceding the turn bar and a module following the turnover module TB can be independently controlled relative to each other further enhancing the flexibility of the printing system. In this example embodiment, the drive motor is included in the turnover module TB. In other example embodiments, the drive motor need not be included in a turnover mechanism. Instead, the drive motor can be appropriately located along the web path so that tension within one module can be independently controlled relative to tension in another module.

The configuration shown in FIGS. 1 and 2 were described as including two modules 20 and 40 with each module providing a complete printing apparatus. However, the "modular" concept need not be restricted to apply to complete printers. Instead, the configuration of FIG. 3 can be considered as including as many as seven modules, as described below.

An entrance module 70 is the first module in sequence, following the media supply roll, as was shown earlier with reference to FIG. 1. Entrance module 70 provides the edge guide A that positions the web media 60 in the cross-track direction and includes the S-wrap tensioning mechanism 24. In the embodiment of FIG. 3, entrance module 70 also provides the in-feed drive roller B that cooperates with the tensioning mechanism 24 and other downstream drive rollers to maintain suitable tension along the web, media 60 as noted earlier. Rollers C, D, and E are also part of entrance module 70 in the FIG. 3 embodiment. Transport roller E preferably includes either a passive centering web guide (for example, by a web guide such as is described in the aforementioned commonly-assigned U.S. Pat. No. 5,360,152) or a servo-caster with gimbaled roller (i.e., a steered angular constraint with hinge) in order to center justify the print media as it enters the media operation zone. The first printhead module 72 accepts the web media 60 from entrance module 70, with the given edge constraint, and applies an angular constraint with fixed roller F. A series of stationary fixed non-rotating supports 32, for example, brush bars or, optionally, minimum-wrap rollers then transport the web along past a first series of printheads 16 with their supporting dryers 14 and other components. Here, because of the considerable web length in the web segment beyond the angular constraint provided by roller F (that is, the distance between rollers F and G), that segment can exhibit flexibility in the cross track direction which is an additional degree of freedom that may need be constrained. As such, in one example embodiment of the present invention roller G is a servo-caster with gimbaled roller (i.e., a steered angular constraint with hinge).

An end feed module 74 provides an angular constraint to the incoming web media 60 from printhead module 72 by means of gimbaled roller H. Turnover module TB accepts the incoming media 60 from end feed module 74 and provides an angular constraint with its drive roller, as described above. Optionally, digital printing system 10 can also include other components within any of the modules described above. Examples of these types of system components include components for inspection of the print media, for example, components to monitor and control print quality.

A forward feed module 76 provides a web span corresponding to each of its gimbaled rollers J and K. These rollers again provide angular constraint only. The lateral constraint for web spans in module 76 is obtained from the edge of the incoming web media 60 itself Roller K includes either a lateral constraint (for example, an additional edge guide like the one included at roller A) or a servo-caster with gimbaled roller (i.e, a steered angular constraint with hinge) in order to maintain the cross-track position of the web media 60.

A second printhead module 78 accepts the web media 60 from forward feed module 76, with the given edge constraint, and applies an angular constraint with fixed roller L. A series of stationary fixed non-rotating supports 32, for example, brush bars or, optionally, minimum-wrap rollers then feed the web along past a second series of printheads 16 with their supporting dryers and other components, while providing little or no lateral constraint on the print media. In one example embodiment of the present invention, roller M is a servo-caster with gimbaled roller (i.e., a steered angular constraint with hinge) to center justify the web media 60 as it leaves the media operation zone that is located between rollers L and M. Here again, because of considerable web length in the web segment (that is, extending the distance between rollers L and M), that segment can exhibit flexibility in the cross track direction which is an additional degree of freedom enabling the use of the steered angular constraint without over constraining the print media in that span.

An out-feed module 80 provides an out-feed drive roller N that serves as angular constraint for the incoming web and cooperates with other drive rollers and sensors along the web media path that maintain the desired web speed and tension. Optional rollers O and P (not shown in FIG. 3) may also be provided for directing the printed web media 60 to an external accumulator or take-up roll.

Each module in this sequence provides a support structure and an input and an output interface for kinematic connection with upstream or downstream modules. With the exception of the first module in sequence, which provides the edge guide at A, each module utilizes one edge of the incoming web media 60 as its "given" lateral constraint. The module then provides the needed angular constraint for the incoming media 60 in order to provide the needed exact constraint or kinematic connection of the web media transport. It can be seen from this example that a number of modules can be linked together using the apparatus and methods of the present invention. For example, an additional module could alternately be added between any other of these modules in order to provide a useful function for the printing process.

When multiple modules are used, as was described with reference to the embodiment shown in FIG. 3, it is important that the system have a master drive roller that is in control of web transport speed. Multiple drive rollers can be used and can help to provide proper tension in the web transport (x) direction, such as by applying suitable levels of torque, for example. In one embodiment, the turnover TB module drive roller acts as the master drive roller. The in-feed drive roller B in entrance module 70 (or, referring to FIG. 2, module 20) adjusts its torque according to a load sensing mechanism or load cell that senses web tension between the drive and in-feed rollers. Similarly, out-feed drive roller N can be controlled in order to maintain a desired web tension within printhead module 78 (or, referring to FIG. 2, module 40).

As noted earlier, slack loops are not required between or within the modules described with reference to FIG. 3. Slack loops can be appropriate, however, where the continuous web is initially fed from a supply roll or as it is re-wound onto a take-up roll, as was described with reference to the printing system 10 shown in FIG. 1.

Figure 4:
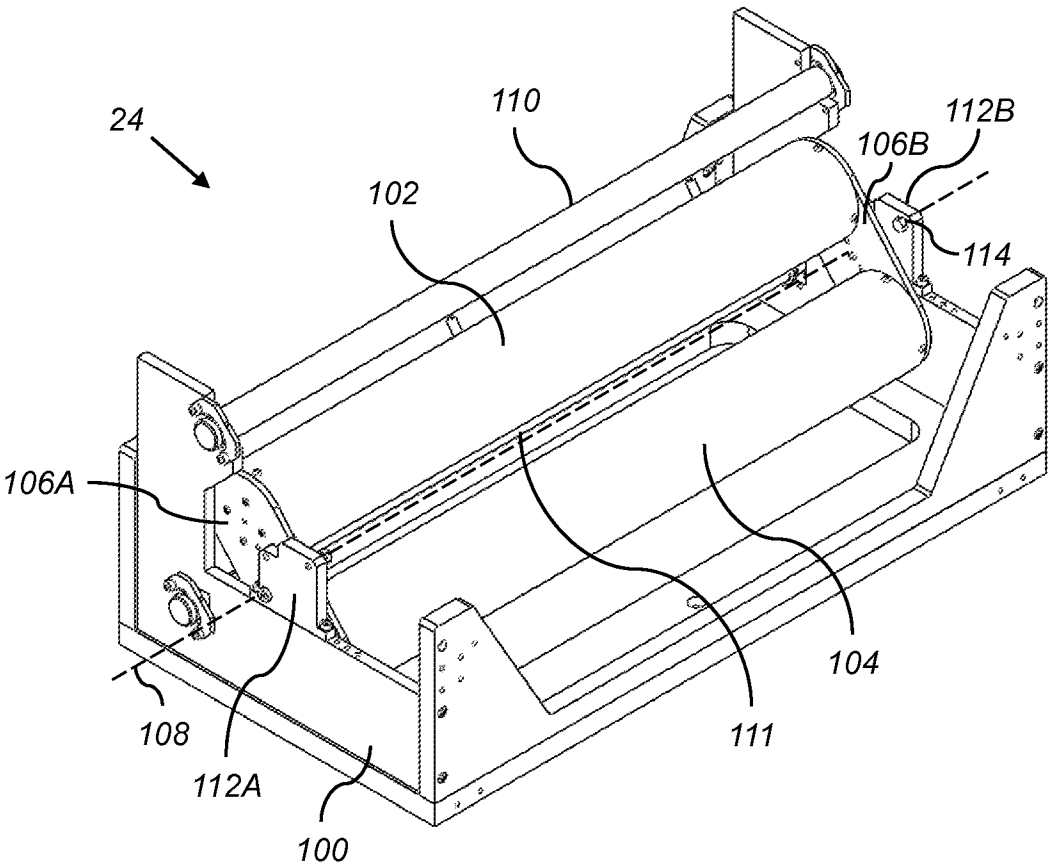
FIG. 4 shows a schematic diagram of an automatically-adjusting tensioning mechanism according to an embodiment of the present invention.

FIG. 4 shows a schematic diagram of an automatically-adjusting tensioning mechanism 24 according to an exemplary embodiment of the present invention. The tensioning mechanism 24 includes a first tensioning shoe 102 and a second tensioning shoe 104, which are attached to a bracket assembly including a pair of bracket plates 106A and 106B. The tensioning shoes 102 and 104 extend in a lengthwise direction across the width of the web media 60 (not shown in FIG. 4), and have curved surfaces over which the web media 60 slides. Friction between the web media 60 and the tensioning shoes 102 and 104 imparts a drag force on the web media 60, thereby producing a corresponding tension. In a preferred embodiment, the tensioning shoes 102 and 104 are hollow cylinders, having cylindrical surfaces. In other embodiments, the tensioning shoes 102 and 104 can use other types of curved surfaces, such as elliptical or parabolic curves. The tensioning shoes 102 and 104 only need to be curved around the portion of the surface which comes in contact with the web media 60.

The bracket assembly (i.e. bracket plates 106A and 106B), is mounted to a frame 100, and is adapted to freely pivot around a pivot axis 108 through a range of pivot angles. The pivot axis 108 is oriented in a direction across the width of the web media 60 (not shown in FIG. 4), the pivot axis being perpendicular to the direction of travel of the web media 60. The bracket assembly is mounted to the frame 100 using bracket mounting plates 112A and 112B, to which the bracket plates 106A and 106B are connected using freely rotating connections as will be described in more detail with respect to FIGS. 5A and 5B. While the bracket assembly illustrated in FIG. 4 is comprised to two bracket plates 106A and 106B, it will be obvious to one skilled in the art that other types of bracket assemblies can be used in accordance with the present invention. For example, in some embodiments only a single bracket plate is used on one end of the tensioning shoes 102 and 104. In other embodiments the bracket assembly may also include other components, such as cross-members that connect the bracket plates 106A and 106B.

In some embodiments, the tensioning mechanism 24 can also include other optional components such as an upper brush bar 110 and a lower brush bar 111 as shown in FIG. 4. These brush bars provide surfaces over which the web media 60 may ride depending on the pivot angle of the bracket assembly. Optionally, an upper stop 114 and a lower stop (not visible in FIG. 4) can be provided to limit the rotation of the bracket assembly to a defined range of pivot angles. The upper stop 114 limits the rotation of the bracket assembly in a counter-clockwise direction, and the lower stop 116 limits the rotation of the bracket assembly in a clockwise direction.

Figure 5B:
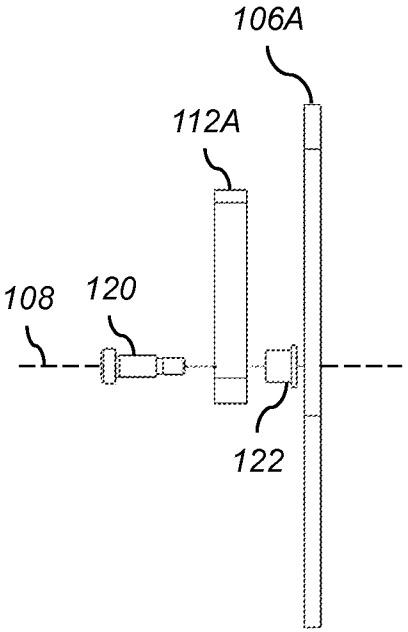
FIGS. 5A and 5B are schematic diagrams showing additional details of the bracket assembly in the automatically-adjusting tensioning mechanism of FIG. 4.
Figure 5A:
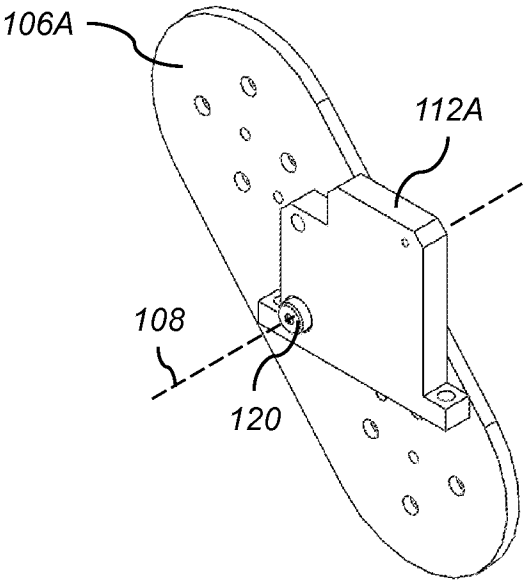

FIGS. 5A and 5B are schematic diagrams showing additional details of the bracket assembly in the tensioning mechanism 24 of FIG. 4. The bracket plate 106A is connected to the bracket mounting plate 112A using a flange bearing 122, which freely rotates around the pivot axis 108 within a hole in the bracket mounting plate 112A. A shoulder screw 120 is inserted through a hole in the center of the flange bearing 122, and is used to attach the flange bearing to the bracket plate 106A. In the illustrated configuration the pivot axis 108 passes through the center of the bracket plate 106A. As will be discussed later, in other configurations, the pivot axis 108 may be positioned off center toward one end or the other of the bracket plate 106A. In some embodiments, a series of holes may be provided in the bracket plate 106A so that the bracket assembly can be reconfigured as desired.

Figure 6B:
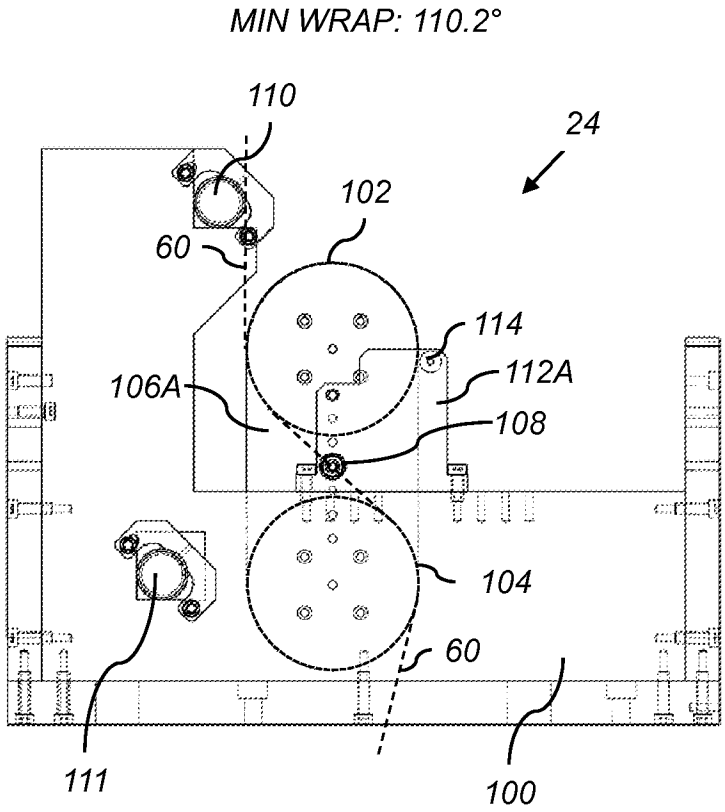
FIGS. 6A and 6B show schematic side view diagrams of the automatically-adjusting tensioning mechanism of FIG. 4 at two different pivot angles in a configuration where the pivot axis is centered with respect to the bracket plates.
Figure 6A:
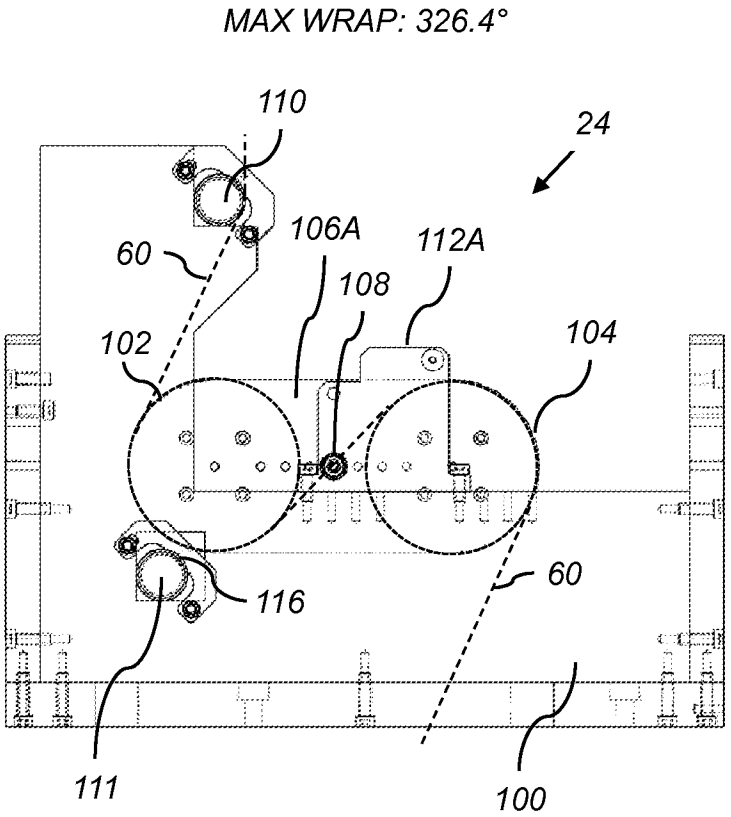

FIGS. 6A and 6B show schematic side view diagrams of the tensioning mechanism 24 of FIG. 4 at two different pivot angles. In the illustrated configuration, the pivot axis 108 is centered with respect to the bracket plate 106A.

In the FIG. 6A diagram, the bracket plate 106A is rotated in a counter-clockwise direction to its limiting pivot angle where it comes in contact with the lower stop 116, thereby preventing further rotation. At this position, the web media 60 is in contact with the tensioning shoes 102 and 104 for a contact distance corresponding to total wrap angle of 326.4°.

In the FIG. 6B diagram, the bracket plate 106A is rotated in a clockwise direction to its limiting pivot angle where it comes in contact with the upper stop 114, thereby preventing further rotation. At this position, the web media 60 is in contact with the tensioning shoes 102 and 104 for a contact distance corresponding to total wrap angle of 110.2°. Since the contact distance in this case is much lower than that shown in FIG. 6A, the drag force placed on the web media 60 will be correspondingly lower. Consequently, the tension in the web media 60 will also be correspondingly lower.

In accordance with the present invention, the pivot angle of the bracket assembly is allowed to freely adjust to provide a passive and automatic adjustment of the tension in the web media 60. As will be discussed in more detail later, the result is that the tension in the web media as it exits the automatically-adjusting tensioning mechanism has a reduced level of variability as a function of the coefficient of friction between the web media and the tensioning shoes 102 and 104 relative to configurations where the bracket assembly is held in a fixed position.

In the embodiment illustrated in FIGS. 6A and 6B, the web media 60 follows an S-shaped media path where the web media 60 feeds down into the tensioning mechanism 24 from the top and passes by the upper brush bar before being wrapped around the lower surface of the first tensioning bar 102. It then wraps over the top surface of the second tensioning bar 104 and exits out the lower side of the tensioning mechanism 24. It will be obvious to one skilled in the art that in other embodiments the tensioning mechanism can be configured to use different media paths. For example, in some embodiments the web media 60 can feed up into the tensioning mechanism 24 from below and wrap around the top surface of the first tensioning bar 102 and the lower surface of the second tensioning bar 104 before exiting out the upper side of the tensioning mechanism 24.

Figure 7B:
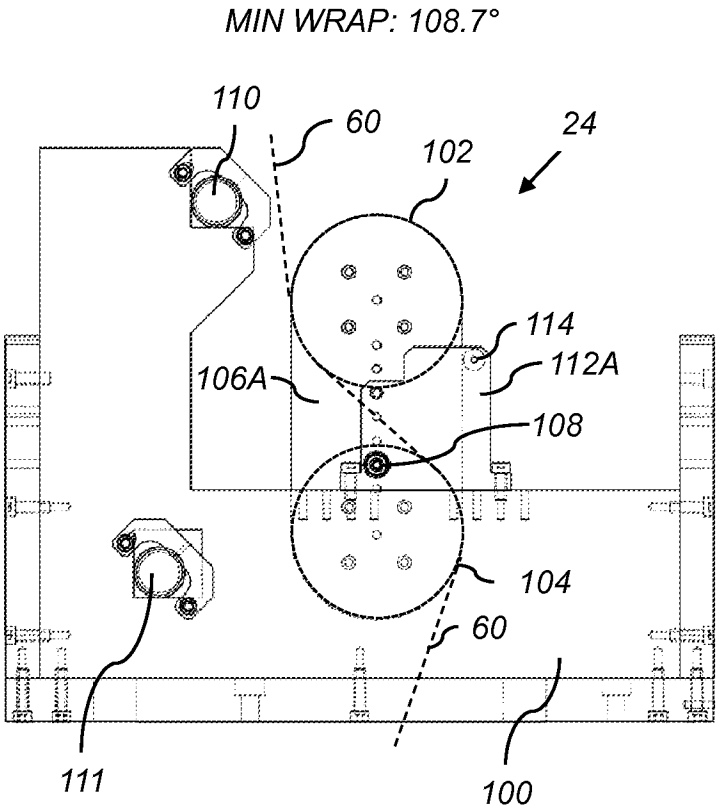
FIGS. 7A and 7B show schematic side view diagrams of the automatically-adjusting tensioning mechanism of FIG. 4 at two different pivot angles in a configuration where the pivot axis is off-center with respect to the bracket plates.
Figure 7A:
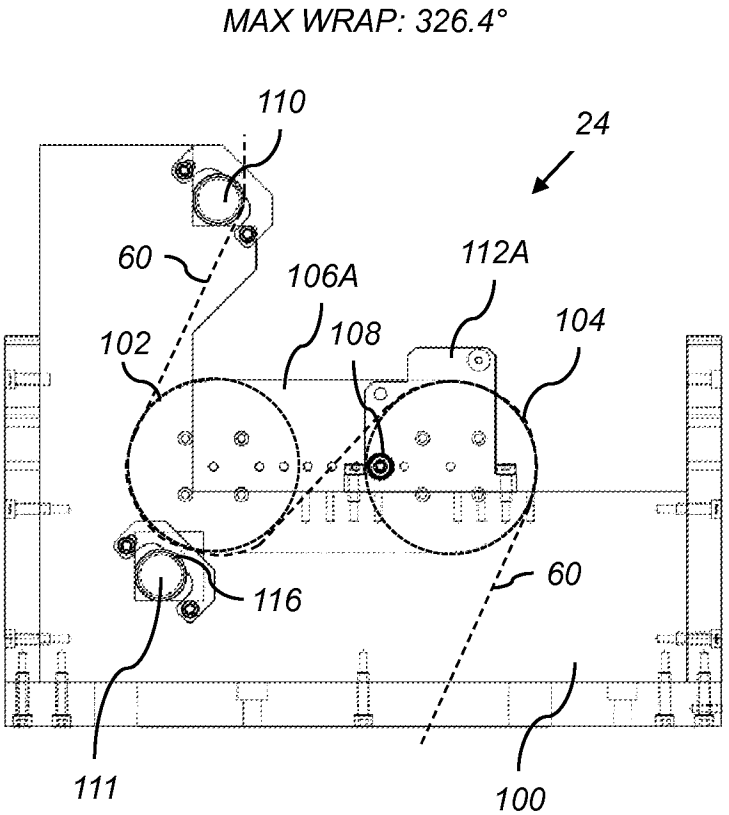

FIGS. 7A and 7B show schematic side view diagrams of a second configuration of the tensioning mechanism 24 of FIG. 4 at two different pivot angles. These figures are similar to those shown in FIGS. 6A and 6B except that in this configuration, the pivot axis 108 is off-center with respect to the bracket plate 106A, being closer to the second tensioning shoe 104 than to the first tensioning shoe 102. In the FIG. 7A position, the web media 60 is in contact with the tensioning shoes 102 and 104 for a contact distance corresponding to total wrap angle of 326.4°, which is the same as that shown in FIG. 6A. In the FIG. 7B position, the web media 60 is in contact with the first tensioning shoes 102 and 104 for a contact distance corresponding to total wrap angle of 110.2°, which is slightly less than that shown in the FIG. 6B configuration. As will be discussed with reference to FIG. 8, the use of an off-center pivot axis is one method for achieving a torque imbalance, which is desirable in many embodiments.

In accordance with the embodiments of FIGS. 6A-6B and 7A-7B, the tensioning mechanism 24 should be configured such that the first tensioning shoe 102 imparts a downward force on the web media as it passes under the bottom of it and the second tensioning bar 104 imparts an upward force on the web media as it passes over the top of it. In a preferred embodiment this is accomplished by creating a torque imbalance in the tensioning mechanism 24. (Note that if a different S-shaped path is used other than that illustrated in FIGS. 6A-6B and 7A-7B, the torque imbalance should be arranged to provide a downward force on the tensioning shoe 102 or 104 that the web media 60 passes under and an upward force on the tensioning shoe 102 or 104 that the web media 60 passes over.)

Figure 8:
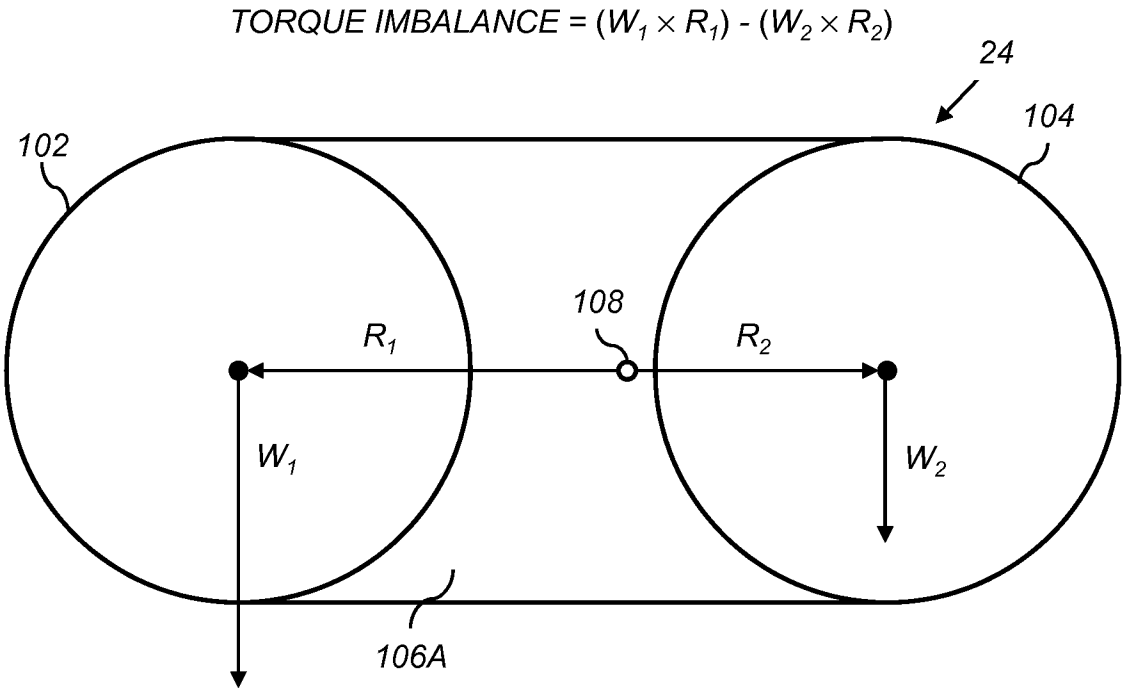
FIG. 8 is a diagram illustrating imbalanced torque components.

FIG. 8 is a diagram illustrating a number of ways that a torque imbalance can be provided according to embodiments of the present invention. The main components of the tensioning mechanism 24 include the tensioning shoes 102 and 104 and the bracket assembly. The bracket assembly is adapted to pivot around the pivot axis 108. When the bracket assembly is in a horizontal position, as shown in FIG. 8, there will be a counter-clockwise torque component produced by gravity acting on the first tensioning shoe 102 (and the portion of the bracket assembly to the left of the pivot axis). Likewise, there will be a clockwise torque component produced by gravity acting on the second tensioning shoe 104 (and the portion of the bracket assembly to the right of the pivot axis).

The counter-clockwise torque component $\tau_1$ will be given by:

$$\tau_1 = W_1 \times R_1 \quad (1)$$

where $W_1$ is the weight of the left-side components (i.e., the first tensioning shoe 102 and the portion of the bracket assembly to the left of the pivot axis), and $R_1$ is the radius to the center of mass for the left-side components. Similarly, the clockwise torque component $\tau_2$ will be given by:

$$\tau_2 = W_2 \times R_2 \quad (2)$$

where $W_2$ is the weight of the right-side components (i.e., the second tensioning shoe 104 and the portion of the bracket assembly to the right of the pivot axis), and $R_2$ is the radius to the center of mass for the right-side components.

The torque imbalance $\Delta\tau$ will be given by the difference between the counter-clockwise torque component $\tau_1$ and the clockwise torque component $\tau_2$:

$$\Delta\tau = \tau_1 - \tau_2 = (W_1 \times R_1) - (W_2 \times R_2). \quad (3)$$

From this equation it can be seen that there are several different ways that the components can be arranged to provide the torque imbalance. In some embodiments the pivot axis 108 can be position off center relative to the bracket plate 106A so that $R_1 > R_2$. This will cause $\tau_1 > \tau_2$ so that $\Delta\tau > 0$. In other embodiments, additional weight can be added to the left-side components so that $W_1 > W_2$. Once again, this will cause $\tau_1 > \tau_2$ so that $\Delta\tau > 0$. In some embodiments, both the weights and the radiuses can be non-equal so that both effects combine to provide the torque imbalance.

Figure 9:
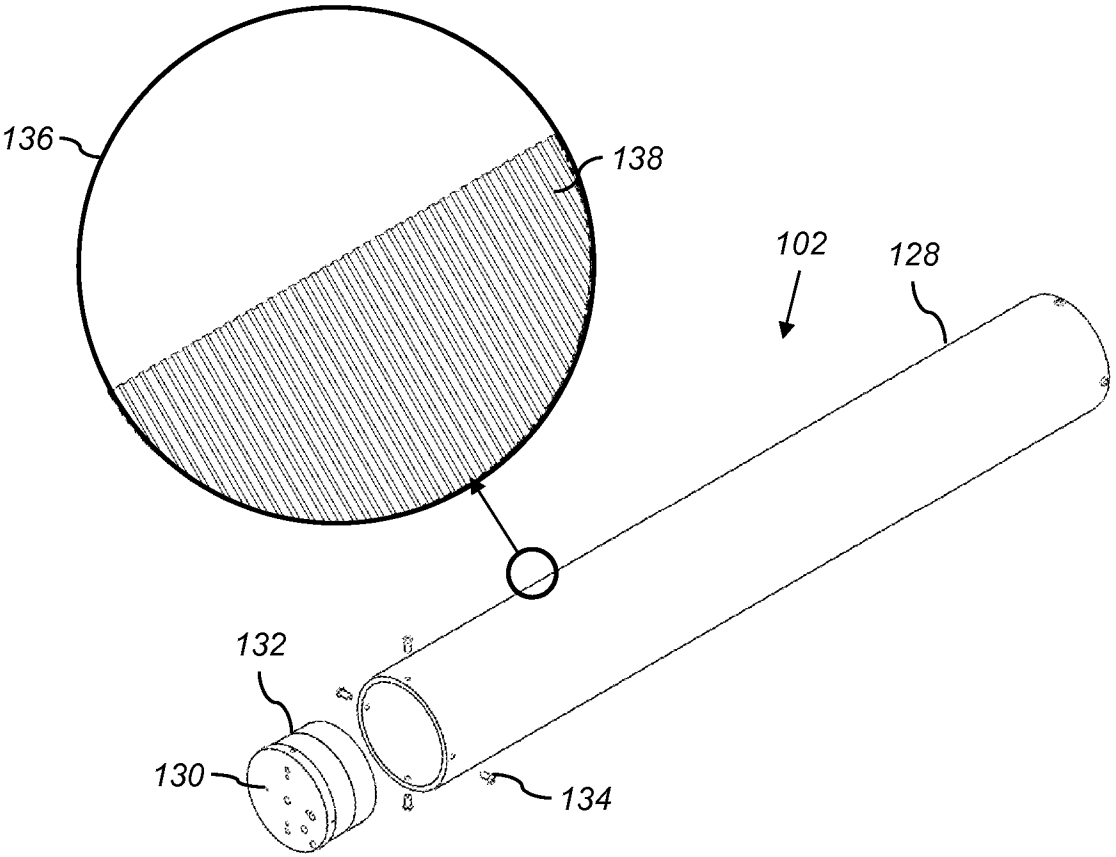
FIG. 9 is a schematic diagram showing a tensioning shoe with added weights to provide a torque imbalance.

There are a number of ways that additional weight can be added to the left-side components to provide the desired torque imbalance. In a preferred embodiment, a weight of the first tensioning shoe 102 is adjusted to be larger than a weight of the second tensioning shoe 104. One way to accomplish this is illustrated in FIG. 9, which illustrates a configuration where the first tensioning shoe 102 is a hollow cylinder 128 having end caps 130. One or more masses 132 are affixed to the end caps 130 before they are attached to the hollow cylinder 128 using screws 134 to provide a larger weight relative to the second tensioning shoe 104. With this approach an arbitrary amount of weight can be added by controlling the size and number of the masses 132. In other embodiments, the weight of the first tensioning shoe 102 can be adjusted by other means such as changing the thickness of the hollow cylinder 128, making the first tensioning shoe 102 from a solid cylinder, or adjusting the material from which the first tensioning shoe 102. In other embodiments, additional weight can be added in proximity to the first tensioning shoe 102 without changing the weight of the first tensioning shoe 102 itself (e.g., by affixing a weight to one or both of the bracket plates 106A and 106B).

In some embodiments, it can be beneficial to form a series of fine grooves 138 (e.g., 40 grooves/inch) into the surface of the tensioning shoes 102 and 104 as illustrated in the inset 136 in FIG. 9. The grooves have the advantage that they prevent air entrapment between the web media 60 and the tensioning shoes 102 and 104. (Air entrapment can result in a reduced drag force since the web media 60 will be floating over air rather than contacting the tensioning shoes 102 and 104.) In a preferred embodiments, the grooves 138 are oriented around the tensioning shoes 102 and 104 in line with the direction of movement for the web media 60. In practice, there is sometimes an advantage to orient them at an angle so that they form spirals around the tensioning shoes 102 and 104. This can reduce the likelihood of marking the web media 60, and also can be advantaged relative to manufacturing the grooves on a lathe mechanism.

The total amount of torque imbalance that is provided in the tensioning mechanism 24 will determine the amount of tension that is introduced into the web media 60. In an application where the tensioning mechanism is used in the printing system 10 with 20 inch wide web media 60, it has been found that providing a total tension in the range of 20-40 lb is desirable. In other applications, the preferred tension may be higher or lower.

There are a number of factors which should be considered when determining the preferred method to provide the torque imbalance. The use of an off-center pivot axis 108 has the advantage that less weight is required to create the same torque imbalance. However, it has the disadvantage that it requires a larger space for the tensioning mechanism 24 to accommodate the larger swing radius. Therefore, for applications where there is a tight space constraint, it is preferable to use a centered pivot axis 108, and to provide the torque imbalance by the addition of weight to the first tensioning shoe 102.

In some embodiments, the torque imbalance can be provided (or supplemented) using other means. For example, an external weight can be attached to the bracket assembly using a cable, or a spring can be connected between the bracket assembly and the frame 100 that provides a torque on the bracket assembly in a direction that opposes the torque applied by the tension in the web media 60. An example embodiment where the torque imbalance is provided by an external weight or spring force will be discussed later with respect to FIGS. 12A-12B.

Figure 10B:
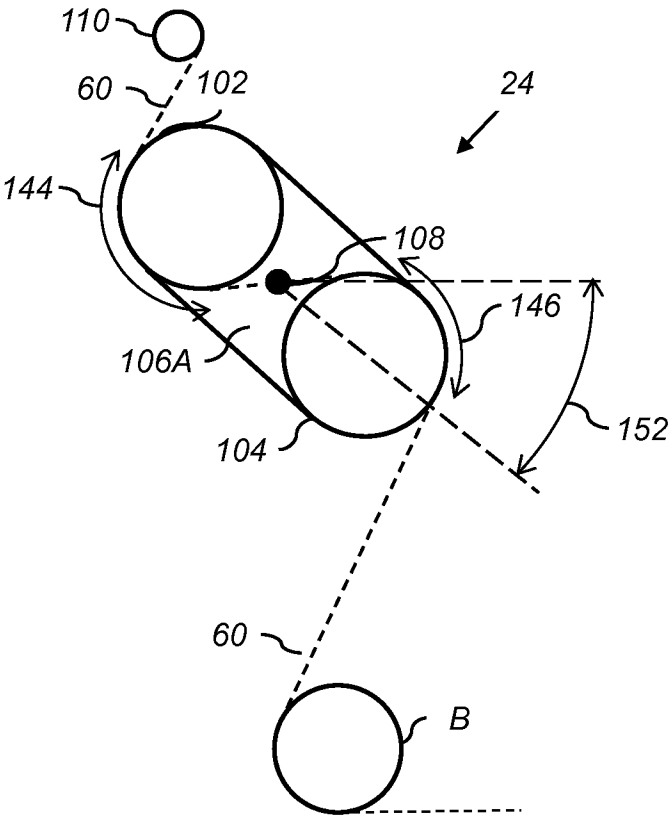
FIGS. 10A and 10B illustrate the automatic adjustment of the pivot angle to provide a reduced variability in the tension of the web media.
Figure 10A:
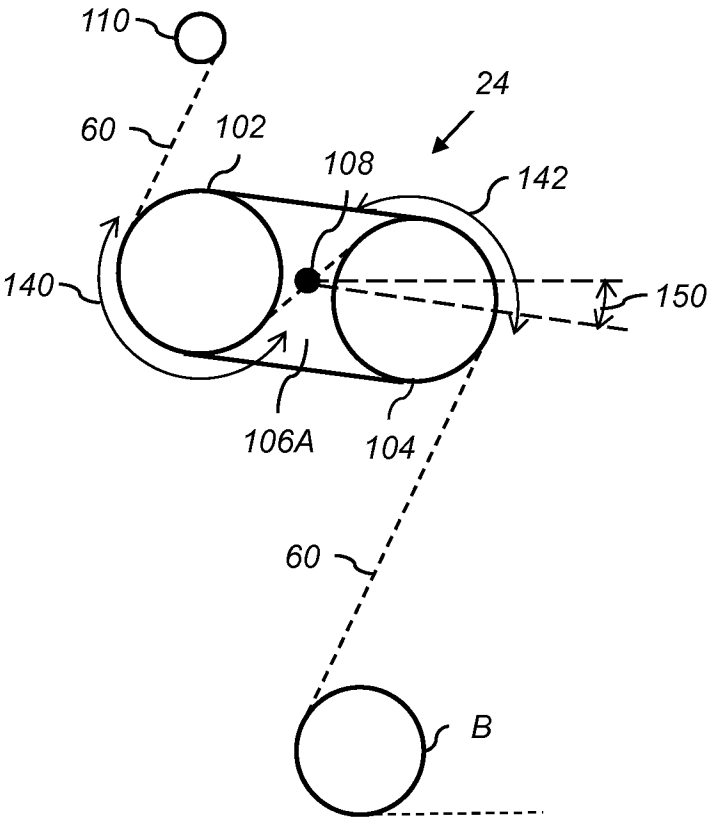

FIGS. 10A and 10B illustrate the automatic adjustment of the pivot angle in the tensioning mechanism 24 to provide a reduced variability in the tension of the web media 60. FIG. 10A shows an initial state of the tensioning mechanism 24 where it is positioned at an initial pivot angle 150. In this orientation the web media 60 contacts the first tensioning shoe 102 through an initial first shoe contact distance 140 and contacts the second tensioning shoe 104 through an initial second shoe contact distance 142. In some embodiments, the web media 60 is received into the tensioning mechanism 24 in a slack state having a negligible level of tension (e.g., if the tensioning mechanism 24 is positioned following a slack loop in the printing system 10.) In other embodiments, there may be some level of tension in the web media before it passes through the tensioning mechanism 24.

Friction between the web media 60 and the tensioning shoes 102 and 104 as the media is pulled through the tensioning mechanism 24 produces a drag force and consequently provides a tension in the web media 60. The magnitude of the drag force will be a function of the coefficient of friction between the web media 60 and the tensioning shoes 102 and 104. There are a variety of different factors that will affect the coefficient of friction including the physical characteristics of the web media 60 (e.g., width, thickness, stiffness, glossiness, texture and chemical composition) and the physical tensioning shoes 102 and 104 (e.g., glossiness, texture, chemical composition of the tensioning shoes 102 and 104, temperature, as well as any coatings that are applied intentionally or contamination that is picked up over time as the web media 60 rubs on the tensioning shoes). It will also be affected by other factors such as the speed that the web media 60 is being pulled through the tensioning mechanism 24 and the environmental characteristics (e.g., temperature and humidity). In some embodiments, the web media 60 may be treated by applying a chemical substance to the surface of the web media 60 before it enters the tensioning mechanism 24 (e.g., a conditioning pre-treatment, or ink applied at an earlier point in a printing process), which can also affect the coefficient of friction. Some of these factors can change gradually over time even if the same type of web media 60 is being used (e.g., environmental characteristics, changes in the physical characteristics of the tensioning shoes 102 and 104 due to wear, heating, burnishing or contamination that build up on the surface). Others of these factors may change when operating conditions (e.g., web speed) are changed, a pre-treatment process is initiated, or a new type of web media 60 is loaded into the roll-fed web media transport system.

Let us assume that the tensioning mechanism 24 in FIG. 10A is initially operating in a steady state condition at the initial pivot angle 150. In this steady state condition, the torques on the tensioning mechanism 24 are balanced such that the clockwise and counter-clockwise torques are the same. The counter-clockwise torque is provided by the torque imbalance of the tensioning shoe 24 that was discussed relative to FIG. 8. The clockwise torque originates from the tension in the web media 60, which results from the frictional drag force produced as the web media 60 is pulled through the tensioning mechanism 24.

If the coefficient of friction between the web media 60 and the tensioning shoes 102 and 104 now increases for some reason (e.g., changing environmental characteristics, different type of web media 60, or different web speed), this will increase the drag force and thereby will increase the tension in the web media 60. As a result, the clockwise torque on the tensioning mechanism 24 will increase, and the torques will no longer be balanced, thereby disturbing the steady state condition. This will cause the tensioning mechanism 24 to rotate in a clockwise direction. As the tensioning mechanism 24 rotates, the contact distance between the web media 60 and the tensioning shoes 102 and 104 will decrease, this will cause the drag force to be reduced, and will consequently reduce the clockwise torque. (The counter-clockwise torque will also change to some degree due to the change in lever arm resulting from the change in the angle between the gravitational force and the orientation of the tensioning mechanism.) The tensioning mechanism 24 will continue to rotate until it reaches a new steady state condition where the torques are once again balanced.

FIG. 10B shows an adjusted state of the tensioning mechanism 24 in FIG. 10A where it has reached a new steady state at an adjusted pivot angle 152. In this orientation the web media 60 contacts the first tensioning shoe 102 through an adjusted first shoe contact distance 144 and contacts the second tensioning shoe 104 through an adjusted second shoe contact distance 146. In the new steady state, the tension in the web media 60 has been reduced to a value at or near the original tension when the system was operating in the initial steady state condition.

FIG. 11 shows a table comparing the variability in the tension of the web media 60 provided with an automatically-adjusting tensioning mechanism 24 in accordance with the present invention to that of a conventional fixed S-wrap tensioning mechanism (having tensioning shoes positioned to provide a 0° "pivot angle." Four different types of web media 60 were compared, one of which was tested with and without a coating applied as a pre-treatment.

With the conventional fixed S-wrap tensioning mechanism, the tension produced in the web media 60 varies over the range of 10-198 lbs. Web media #2 has the highest coefficient of friction, and therefore produces the highest tension. (This tension was so high that it actually resulted in the media breaking during the test.) Web media #4 has the lowest coefficient of friction, and accordingly produces the lowest tension. The application of the pre-treatment coating to web media #3 significantly lowers the coefficient of friction, and consequently lowers the tension provided by the conventional S-wrap tensioning mechanism. This range of tensions would be too large to provide acceptable system performance for many of the media types (the tension should preferably be in the range of 15-40 lbs). A costly and time consuming manual reconfiguration of the S-wrap tensioning mechanism would therefore be required to determine an acceptable operating position for the S-wrap tensioning mechanism each time the web media is changed.

In accordance with the present invention, the pivot angle of the automatically-adjusting tensioning mechanism 24 automatically adjusts to the characteristics of the different web media types in FIG. 11, thereby providing a reduced variability in the tension of the web media 60. The range of tensions in this case is reduced to the range 16-33 lbs. Aside from web media #2, the range of tensions was even smaller (16-26 lbs). The tension of web media #2 was somewhat higher because the pivot angle of the automatically-adjusting tensioning mechanism 24 had reached its maximum pivot angle (80°), and therefore could not pivot any more to further reduce the tension. The range of tensions provided by the automatically-adjusting tensioning mechanism 24 is more than a 10× improvement relative to the fixed S-wrap tensioning mechanism, and is within the range of acceptable tensions to achieve satisfactory system performance for a typical printing system 10. Consequently, using the automatically-adjusting tensioning mechanism 24 of the present invention is effective to eliminate the costly and time-consuming manual reconfiguration process required using the conventional S-wrap tensioning mechanism.

It has been found that when the printing system 10 is initially started up, it typically takes some initial period of time until the system reaches a steady state condition. During this initial period of time, the tension in the web media 60 can vary significantly when using a conventional S-wrap tensioning mechanism as the various the characteristics of the various system components change (e.g., due to heating). This can significantly complicate the process of manually adjusting the configuration of the conventional S-wrap tensioning mechanism, and can sometimes result in significant frustration for the system operators. However, in accordance with the present invention, the automatically-adjusting tensioning mechanism 24 will continuously and passively adjust to account for the changing system characteristics without the need for any manual operator interaction.

Figure 12B:
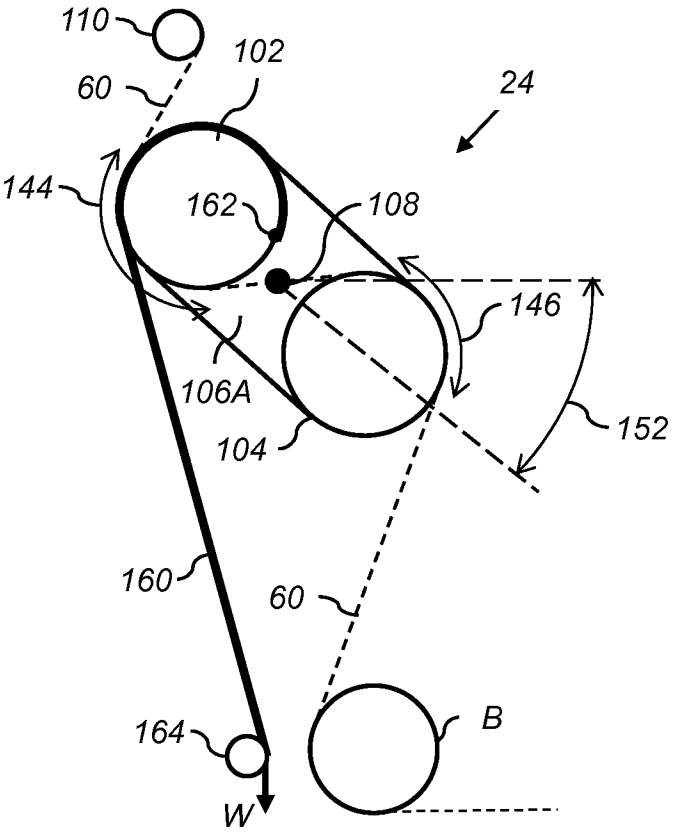
FIGS. 12A and 12B illustrate an alternate embodiment which uses an external force to provide the torque imbalance in the automatically adjusting tensioning mechanism.
Figure 12A:
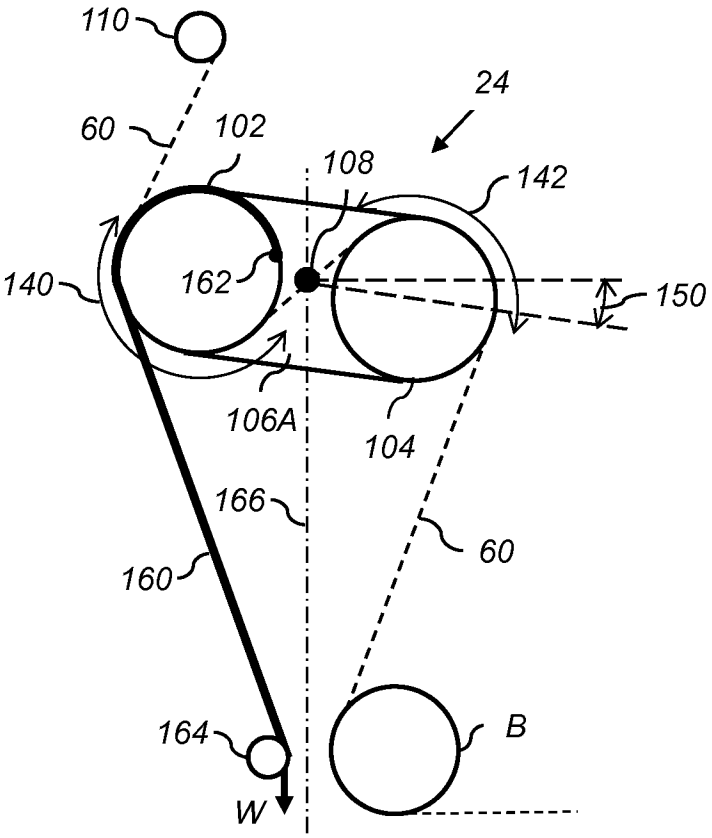

FIGS. 12A and 12B illustrate an alternate embodiment where the torque imbalance for the tensioning mechanism 24 is provided by an external weight or spring. In this embodiment, a cable 160 is attached to the tensioning shoe 102 at a connection point 162. The cable 160 is wrapped around the tensioning shoe 102 and around a pulley 164. A force W is exerted on the cable 160 by an external weight (not shown) hanging from the cable or by a spring (not shown) attached to the frame 100 (not shown in these figures). The magnitude of the force W will determine the tension provided in the web media 60. If a spring is used to provide the force W, preferably a constant force spring should be used so that the tension in the web media 60 will also be constant.

In a preferred embodiment, the position of the pulley 164 will be symmetric with the position of the roller B relative to the axis of symmetry 166, which passes vertically through the pivot axis 108. This arrangement has the advantage that as the tensioning mechanism 24 rotates around the pivot axis 108 (e.g., to the position in FIG. 12B), the lever arm corresponding to the tension in the web media 60 will vary in the same way that the lever arm corresponding to the tension in the cable 160 varies. As a result, the variation in the tension added to the web media 60 will be minimized. In some embodiments, the cable 160 and external force W can be arranged in alternate geometries to accommodate the space available, and to avoid interference between the cable 160, the pulley 164 and other components, such as the roller B.

Figure 13B:
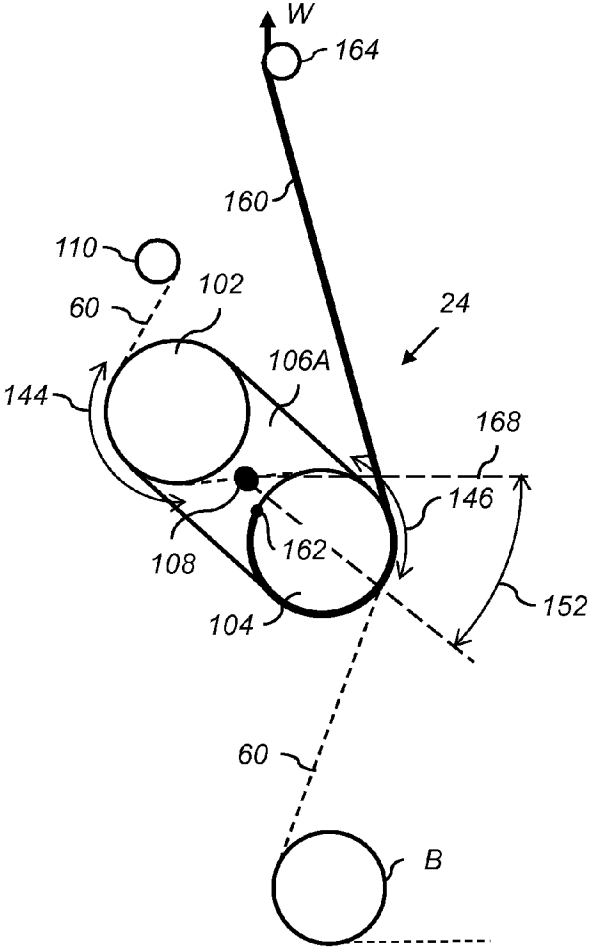
FIGS. 13A and 13B illustrate another alternate embodiment which uses an external force to provide the torque imbalance in the automatically adjusting tensioning mechanism.
Figure 13A:
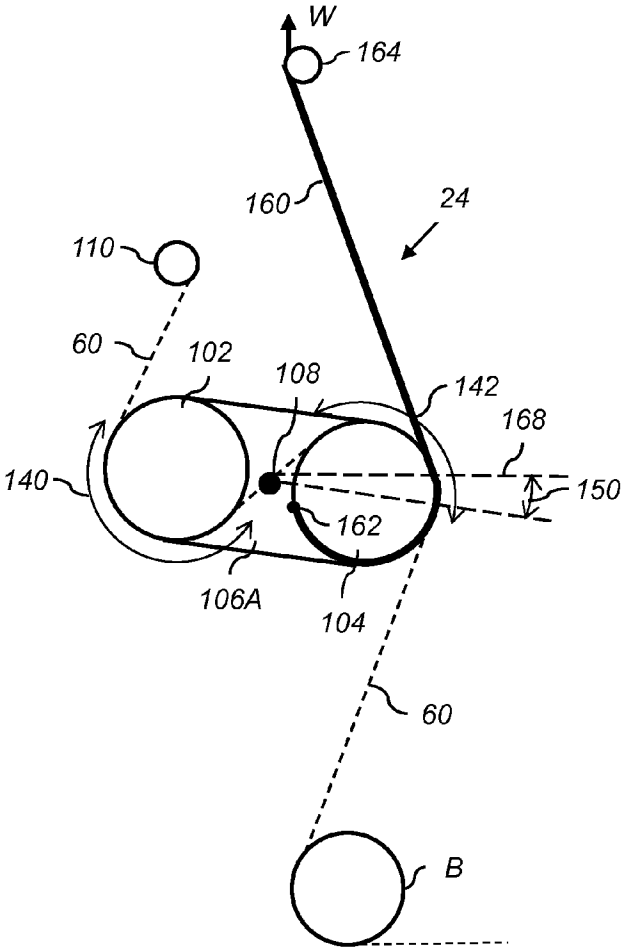

As shown in FIGS. 13A and 13B, in other embodiments, the cable 160 can be attached to the tensioning shoe 104 and can be used to provide an upward force that opposes the force from tension in the web media 60. As with the embodiment of FIGS. 12A-12B, a force W is exerted on the cable 160 by an external weight or a spring (not shown). In the arrangement of FIGS. 13A-13B, the position of the pulley 164 will preferably be symmetric with the position of the roller B relative to a horizontal axis of symmetry 168 that passes through the pivot axis 108. In this way, as the tensioning mechanism 24 rotates around the pivot axis 108 (e.g., from the position in FIG. 13A to the position in FIG. 13B), the lever arm corresponding to the tension in the web media 60 will vary in the approximately same way that the lever arm corresponding to the tension in the cable 160 varies.

The invention has been described in detail with particular reference to certain preferred embodiments thereof, but it will be understood that variations and modifications can be effected within the spirit and scope of the invention.

PARTS LIST

10 printing system
12 source roller
14 dryer
16 printhead
18 take-up roll
20 module
22 cross-track positioning mechanism
24 tensioning mechanism
26 constraint structure
28 support structure
30 turnover mechanism
32 supports
40 module
48 support structure
52 slack loop
54 print zone
60 web media
70 entrance module
72 printhead module
74 end feed module
76 forward feed module
78 printhead module
80 out-feed module
90 control logic processor
100 frame
102 tensioning shoe
104 tensioning shoe
106A, 106B bracket plates
108 pivot axis
110 upper brush bar
111 lower brush bar
112A, 112B bracket mounting plates
114 upper stop
116 lower stop
120 shoulder screw
122 flange bearing
128 hollow cylinder
130 end cap
132 masses
134 screws
136 inset
138 grooves
140 initial first shoe contact distance
142 initial second shoe contact distance
144 adjusted first shoe contact distance
146 adjusted second shoe contact distance
150 initial pivot angle
152 adjusted pivot angle
160 cable
162 connection point
164 pulley
166 axis of symmetry
168 axis of symmetry
A edge guide
B, C, D, E, F, G, H, I, J, K, L, M, N, O, P rollers
TB turnover module
$R_1$, $R_2$ radius
$W_1$, $W_2$ weights
W Force

The invention claimed is:

1. An automatically-adjusting tensioning mechanism for use in a roll-fed web media transport system, the tensioning mechanism adding tension to the web media, the web media having a width, comprising:

a bracket assembly mounted to a frame, the bracket assembly being adapted to freely pivot around a pivot axis through a range of pivot angles, the pivot axis being oriented in a direction across the width of the web media;

a first tensioning shoe extending in a lengthwise direction across the width of the web media and having a first curved surface around which the web media slides, the first tensioning shoe being attached to the bracket assembly;

a second tensioning shoe extending in a lengthwise direction across the width of the web media and having a second curved surface around which the web media slides, the second tensioning shoe being attached to the bracket assembly at a fixed distance from the first tensioning shoe; and a weight attached to the bracket assembly or one of the tensioning shoes using a cable to provide a torque on the bracket assembly;

wherein the web media feeds through the automatically-adjusting tensioning mechanism in an S-shaped media path where the web media is wrapped around the first curved surface of the first tensioning shoe and is wrapped around the second curved surface of the second tensioning shoe such that a frictional drag is produced as the web media slides around the first and second curved surfaces resulting from friction between the web media and the first and second curved surfaces, thereby providing a tension in the web media as it exits the automatically-adjusting tensioning mechanism, the web media being in contact with the first curved surface for a first contact distance and being in contact with the second curved surface for a second contact distance;

wherein the torque provided by the weight opposes a torque on the bracket assembly provided by the frictional drag produced as the web media slides around the first and second curved surfaces;

and wherein the pivot angle of the bracket assembly automatically adjusts as the web media passes through the automatically adjusting tensioning mechanism in response to differences in a coefficient of friction between the web media and the first and second tensioning shoes such that the tension in the web media as it exits the automatically-adjusting tensioning mechanism has a reduced level of variability as a function of the coefficient of friction relative to configurations where the bracket assembly is held in a fixed position.

2. The automatically-adjusting tensioning mechanism of claim 1 wherein the web media is wrapped around a lower side of the first tensioning shoe and around an upper side of the second tensioning shoe, and wherein the automatically-adjusting tensioning mechanism experiences a first torque component relative to the pivot axis corresponding to a downward force at the first tensioning shoe and an opposing second torque component relative to the pivot axis corresponding to a downward force at the second tensioning shoe, the torque components being imbalanced such that the first torque component is larger than the second torque component so that a net torque results on the automatically-adjusting tensioning mechanism, thereby providing a downward force on the first tensioning shoe and an upward force on the second tensioning shoe.

3. The automatically-adjusting tensioning mechanism of claim 2 wherein an increase in the coefficient of friction between the web media and the first and second tensioning shoes causes the pivot angle of the bracket assembly to change, thereby reducing the first and second contact distances.

4. The automatically-adjusting tensioning mechanism of claim 2 wherein the imbalance in the torque components is provided, at least in part, by a distance between the first tensioning shoe and the pivot axis being larger than a distance between the second tensioning shoe and the pivot axis.

5. The automatically-adjusting tensioning mechanism of claim 2 wherein the imbalance in the torque components is provided, at least in part, by adding an additional weight to the bracket assembly within or in proximity to the first tensioning shoe.

6. The automatically-adjusting tensioning mechanism of claim 2 wherein the imbalance in the torque components is provided, at least in part, by a weight of the first tensioning shoe being larger than a weight of the second tensioning shoe.

7. The automatically-adjusting tensioning mechanism of claim 6 wherein first and second tensioning shoes have hollow cores, and wherein the weight of the first tensioning shoe is increased by inserting a mass into the hollow core of the first tensioning shoe.

8. The automatically-adjusting tensioning mechanism of claim 2 wherein the imbalance in the torque components is provided, at least in part, by the torque provided by the weight.

9. The automatically-adjusting tensioning mechanism of claim 8 wherein the cable is wrapped around at least a portion of the first tensioning shoe and the cable passes over a pulley positioned so that the cable places a force on the tensioning mechanism that is substantially symmetric with the force that the web media places on tensioning mechanism with respect to a vertical line passing through the pivot axis.

10. The automatically-adjusting tensioning mechanism of claim 1 wherein the first and second tensioning shoes are cylinders.

11. The automatically-adjusting tensioning mechanism of claim 1 wherein the first and second tensioning shoes have grooved surfaces.

12. The automatically-adjusting tensioning mechanism of claim 1 wherein the web media enters the automatically-adjusting tensioning mechanism in a slack state having a negligible level of tension.

13. The automatically-adjusting tensioning mechanism of claim 1 wherein the differences in the coefficient of friction between the web media and the first and second tensioning shoes result from using different web media having different physical characteristics.

14. The automatically-adjusting tensioning mechanism of claim 1 wherein the differences in the coefficient of friction between the web media and the first and second tensioning shoes result from different environmental characteristics.

15. The automatically-adjusting tensioning mechanism of claim 1 wherein the differences in the coefficient of friction between the web media and the first and second tensioning shoes result from the application of one or more chemical substances to the surface of the web media.

16. The automatically-adjusting tensioning mechanism of claim 1 wherein the differences in the coefficient of friction between the web media and the first and second tensioning shoes result from changes in the surface characteristics of the first and second tensioning shoes due to wear or due to contamination.

17. The automatically-adjusting tensioning mechanism of claim 1 wherein the bracket assembly includes a first bracket plate to which a first end of the first and second tensioning shoes are attached and a second bracket plate to which a second opposite end of the of the first and second tensioning shoes are attached.

18. The automatically-adjusting tensioning mechanism of claim 1 wherein the roll-fed web media transport system is used in a roll-fed printing system that deposits one or more colorants onto a surface of the web media.

19. The automatically-adjusting tensioning mechanism of claim 1 wherein the roll-fed web media transport system is used in a roll-fed coating system that coats one or more layers of material onto a surface of the web media.

20. A method for automatically adjusting a level of tension in web media being transported in a roll-fed web media transport system, the web media having a width, comprising:

receiving web media into an automatically-adjusting tensioning mechanism from a source roller, the automatically-adjusting tensioning mechanism including:

a bracket assembly mounted to a frame and adapted to freely pivot around a pivot axis through a range of pivot angles, the pivot axis being oriented in a direction across the width of the web media;

a first tensioning shoe extending in a lengthwise direction across the width of the web media and having a first curved surface around which the web media slides, the first tensioning shoe being attached to the bracket assembly; and a second tensioning shoe extending in a lengthwise direction across the width of the web media and having a second curved surface around which the web media slides, the second tensioning shoe being attached to the bracket assembly at a fixed distance from the first tensioning shoe; and a weight attached to the bracket assembly or one of the tensioning shoes using a cable to provide a torque on the bracket assembly;

feeding the web media through an S-shaped media path in the automatically-adjusting tensioning mechanism where the web media is wrapped around the first curved surface of the first tensioning shoe and is wrapped around the second curved surface of the second tensioning shoe such that a frictional drag is produced as the web media slides around the first and second curved surfaces resulting from friction between the web media and the first and second curved surfaces, thereby providing a tension in the web media as it exits the automatically-adjusting tensioning mechanism, the web media being in contact with the first curved surface for a first contact distance and being in contact with the second curved surface for a second contact distance, wherein the torque provided by the weight opposes a torque on the bracket assembly provided by the frictional drag produced as the web media slides around the first and second curved surfaces, and wherein the pivot angle of the bracket assembly automatically adjusts as the web media passes through the automatically-adjusting tensioning mechanism in response to differences in a coefficient of friction between the web media and the first and second tensioning shoes such that the tension in the web media as it exits the automatically-adjusting tensioning mechanism has a reduced level of variability as a function of the coefficient of friction relative to configurations where the bracket assembly is held in a fixed position; and pulling the web media through the automatically-adjusting tensioning mechanism using a feed mechanism provided downstream of the automatically-adjusting tensioning mechanism.

* * * * *